United States Patent [19]

Bartsch

[11] 4,336,790

[45] Jun. 29, 1982

[54] COMBUSTION APPARATUS AND METHOD OF ASSEMBLY

[76] Inventor: Gunther M. Bartsch, P.O. Box 1935, Zephyr Cove, Nev. 89448

[21] Appl. No.: 164,247

[22] Filed: Jun. 30, 1980

[51] Int. Cl.[3] ..... F24C 1/00; F24B 7/00

[52] U.S. Cl. ..... 126/58; 126/121; 126/123; 126/126; 126/134; 126/67

[58] Field of Search ..... 126/120, 121, 131, 132, 126/55, 50, 58, 67, 68, 4, 6, 34, 126, 134; 237/51

[56] References Cited

U.S. PATENT DOCUMENTS

| | | | |
|---|---|---|---|
| 1,507,473 | 9/1924 | Dray | 126/120 |
| 2,183,458 | 12/1939 | Lathrop | 126/121 |
| 3,301,249 | 1/1967 | Hendricks | 126/120 |
| 3,640,266 | 12/1972 | Ernest | 126/113 |
| 3,721,225 | 3/1973 | Tidwell | 126/120 |
| 3,855,371 | 12/1974 | Morrow et al. | 126/113 X |
| 3,874,364 | 4/1975 | Fauser | 126/121 |
| 4,016,859 | 4/1977 | Landowski | 126/120 |
| 4,094,301 | 6/1978 | Rohr | 126/400 |
| 4,174,700 | 11/1979 | Bartsch | 126/121 |

*Primary Examiner*—Larry Jones
*Attorney, Agent, or Firm*—Herbert C. Schulze

[57] ABSTRACT

This is a new fireplace, which is either constructed in place or is totally prefabricated in advance and placed within a building where desired. The fireplace is particularly characterized by a pair of overlapping hollow members placed within the throat of the fireplace above the combustion chamber, wherein one of the hollow chambers receives cool air which is heated and then expelled for use, and a second chamber in which an arrangement of tubular members is embedded carrying water into the tubular arrangement for purposes of heating and then bringing the water out of the fireplace. A humidifying liquid is presented into the first chamber and an adjustment for changing the size of the throat is also provided. A method of constructing and assembling the fireplace, or combustion apparatus, in such a manner that it can be prefabricated away from the site of installation.

6 Claims, 8 Drawing Figures

COMBUSTION APPARATUS AND METHOD OF ASSEMBLY

CROSS REFERENCE TO RELATED PATENT APPLICATIONS

A patent application filed by myself on Nov. 7, 1977 and having issued on Nov. 20, 1979 is herewith mentioned. The patent number of this application is U.S. Pat. No. 4,174,700.

BACKGROUND OF THE INVENTION

1. Field of the Invention

This invention is in the general field of fireplaces, and more particularly in the field of fireplaces wherein auxiliary heating chambers are provided within the fireplace, particularly above the combustion chamber, wherein one chamber receives cool air and expells hot air to various portions of the building as desired, and the second chamber heats incoming cold water through a series of tubular configurations and expels hot water to various portions of a building. The first chamber is also provided with a means for injecting water to be changed into steam and thereby brought into the various parts of the building for purposes of keeping the air humid to a desired level.

2. Description of the Prior Art

There have been many advances over the past several years in the field of fireplace arrangements wherein efforts are made to capture heat which is otherwise lost by going up the chimney, or is not effectively directed where it can be used for maximum heating purposes. All these devices encompass metal shelves, or the like, which are utilized to draw in cold air and expel heated air by reason of heat generated adjacent said shelves in the fireplace.

A number of such devices are on the market, and it would be difficult to describe them all. All, however, work on basically the same principle.

In the case of the present invention, a different theory is utilized wherein a pair of overlapping partitions are used within the throat of the chimney above the combustion chamber and are placed in such a manner so as to heat a supply of incoming air into the lower chamber, and to heat a supply of incoming water through a series of pipe coils placed atop the upper shelf. Also, provisions are made for adjusting the size of the fireplace throat at the level of the upper shelf by means of a damper actuated from the outside of the fireplace. The present invention has within it the capability of humidifying the heated air which can be drawn in from the heated building and is again reheated and compensated with moisture to fulfill the depeated humidity in the air through this second process.

SUMMARY OF THE INVENTION

I have been engaged in the installation of fireplaces in various housing structures for some period of time, and I have also become familiar with the fuel and energy shortages in the United States and the desirability of achieving maximum effectiveness of heating from fireplaces.

It is well known that fireplaces are generally very inefficient as heating devices, but are utilized because of their attractiveness and desirability.

A number of innovations have been made over a period of years, which have attempted to enhance the heating quality of fireplaces, as well as, the efficiency.

Most of the new fireplaces designed to be more efficient include a hollow metal shell, or the like, such as the well known "Heatilator" and the like. Also, efforts have been made to provide heat reflecting surfaces, or the like, in conjunction with fireplaces.

All of the devices devised to date have the common quality that they attempt to direct more heat in the area at the front of the fireplace.

In general, the devices involved do not provide for maximizing the combustion of wood or other fuels burned in a fireplace, and, additionally they do not provide for the distribution of heat to other areas. Likewise the devices now in use do not take advantage of the large amount of heat that appears at the very throat of the fireplace.

I have now devised a system wherein I utilize a hollow chamber above the throat of the fireplace, encompassing most of the area, with a second interrupting shelf arranged so as to act as a heat collecting member for the purpose of heating water.

I have connected an air intake to one side of the hollow chamber with heated air outlet on the other side of said chamber. The outlet is then connected to a duct which can lead to other rooms or other portions of the home, or can be directed into the same room in which the fireplace is located, and can be even directed into into a central heating system of the building.

Normally, blowers are used to force the air through the heating chambers in throat of the fireplace.

It is an object of this invention to provide a combustion chamber having a special heating chamber connected to ducts which can take the heat from the fireplace to other portions of the building.

Another object of this invention is to provide such a fireplace as described wherein the amount of air entering the combustion chamber of the fireplace can be controlled.

Another object of this invention is to provide means for heating a coil of pipe through which water can be passed and then distributed to other parts of a building after drawing the air from the interior of the building or the outside atmosphere.

Another object of this invention is to provide such a fireplace that can be prefabricated in a factory or plant away from the site of the installation of the fireplace.

The foregoing and other object snd advantages of this invention will become apparent to those skilled in the art upon reading the description of a preferred embodiment which follows in conjunction with the appended drawings.

DESCRIPTION OF A PREFERRED EMBODIMENT

Figure 1:
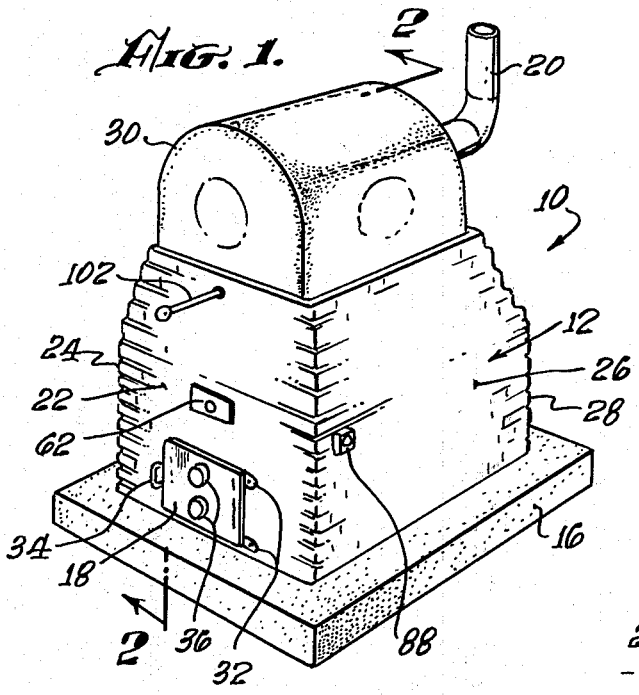
FIG. 1 is a perspective view of a fireplace ultiizing a preferred embodiment of this invention.

The fireplace of my invention is illustrated generally by the reference numeral 10 as viewed in FIG. 1, and to those familiar in the art, the fireplace can be faced with brick or rock as indicated in the drawing. The facing 12 is fabricated to surround a liner 14 of firebrick or a composition of cast material such as is used to resist extreme temperatures and the factors of expansion and contraction. The whole structure is placed upon a base of brick or any other concrete-like material indicated by the reference numeral 16. This whole assembly can be constructed on the site or be prefabricated at a plant and then brought to the location.

As is well known in the art of fireplace construction, an access door 18, with or without glass, is mounted over an opening in the fireplace construction. A chimney 20 of conventional construction is then put into the fireplace in order to exhaust the gases. The body of the fireplace comprises front, left side, right side, and rear walls 22 through 28, respectively. The upper portion of the fireplace construction is formed into a dome-like configuration 30.

The door 18 is mounted by hinges 32 onto the front wall 22 of the fireplace, and the door is provided with a handle 34 and one or more adjustable draft units 36, commonly known in the art. Inside of the door and resting on the base is a grate 38 onto which fuel 40 is placed in order to be burned as a conventional fireplace. The combustion takes place in the lower compartment 42, passes through an intermediate compartment 44 and then into an upper compartment 46. Fuel is placed into the lower compartment through an opening 48 and this opening is also used for cleaning out the ashes left from the combustion.

The heat from the combustion process passes first against and around a hollow chamber 50 supported by a bracket 52 onto the inside wall of the liner 14. An inlet pipe 54 constructed of a heat resistant material is brought through the wall of the chamber into the hollow interior of the chamber. At the other end of the chamber 50 an outlet pipe 56 which is the means for the heated air within the chamber 50 to be passed through a grate at an outlet opening 58.

An opening 60 is located adjacent the chamber 50 and is connected to the interior of said chamber. A closure 62 can be opened in an emergency situation when the blower fails to operate because of electrical or mechanical failure, allowing the chamber to have an air supply coming from within the building to be heated for distribution through outlet pipe 56.

Additionally, another opening 61 is provided for purposes of cleaning out the accumulated residue which builds up above chamber 50 and heat sink 90 which will be described later in this application. This additional opening is provided with a closure 63.

A blower 64 which is provided with a motor 66 brings air in from the interior of the building through an air regulated opening 70, or from the outside atmosphere through a duct 73 passing through an opening 72 in the wall 71 of the building.

A recess is provided in the base 16 in order to offer a catch basin for any ash left over from the combustion of the fuel 40, and a port 78 with a regulating valve 80 is connected to this catch basin. This allows for the manufacture of a draft coming in underneath the fuel supporting grate.

A vital addition to the air being heated within the chamber 50 is the provision of an injection nozzle 82 which sprays a regulated amount of moisture passing through pipe 84 and controlled by a valve 86. This injection of water into the chamber 50 creates a steam which eventually humidifies the air within the building. An automatic control 88 can be placed on the outside of the combustion apparatus, as shown in FIG. 1, and the humidity within the room can be regulated by this method.

A second partition 90, placed on support braket 92 within the throat of the fireplace, is constructed of a fire resistant material having a coil of pipe 94 embedded within this material allowing cold water coming in through line 96 and out of line 98 for distribution throughout the building.

Mounted atop the second wall 90 is a throat damper plate 100. A handle 102 passes to the outside of the fireplace and allows an operator to slide the throat plate 100 within guides 104 to vary the size of the throat 110. A stop 106 is provided to limit the amount of movement of the plate 100.

Figure 6:
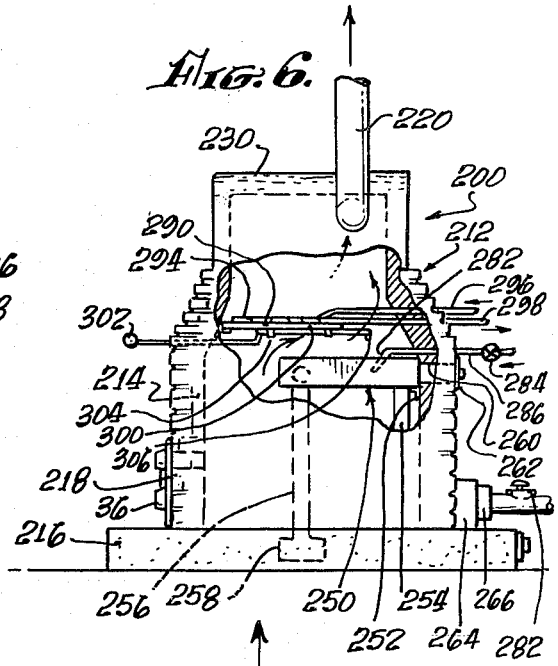
FIG. 6 is a side elevational view on a reduced scale partly in section illustrating an alternate embodiment of my invention.
Figure 2:
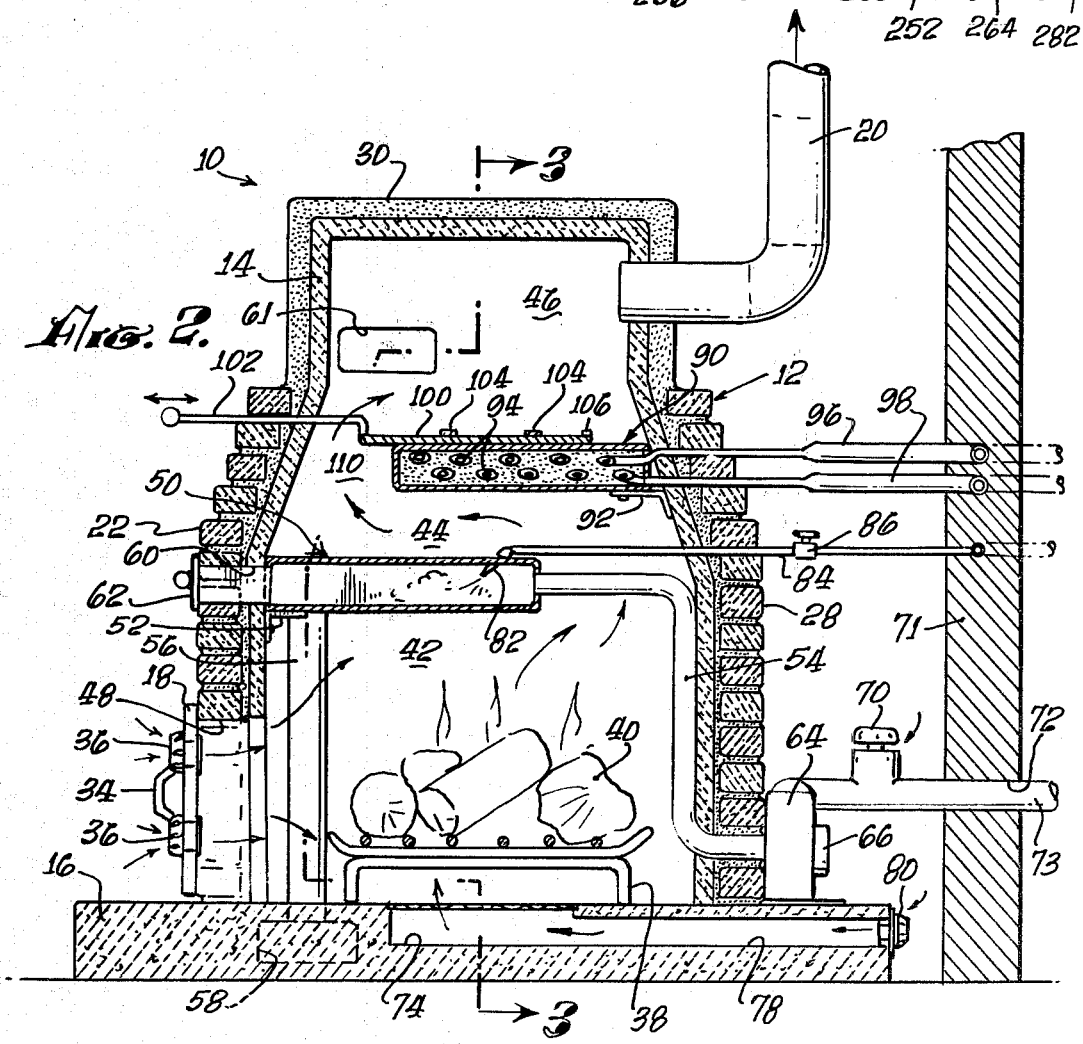
FIG. 2 is an enlarged section taken on line 2—2 of FIG. 1.

In FIG. 6 I have shown an alternate embodiment of my invention wherein the combustion apparatus 200 covered with facing 212 and having an inner liner 214 is mounted upon a base 216. A door 218 and a chimney 220 are provided as described in the earlier embodiment.

In this configuration, the first shelf-like chamber 250 is mounted on a bracket 252 and is provided with an inlet pipe 254 for moving air through the chamber and out of an outlet pipe 256. This pipe exhausts out of opening 258 in the base to be distributed throughout the building. In this case the opening 260 and door 262 are provided for emergencies. The blower 264 and its motor 266 are mounted at the rear of the fireplace and draw air through the regulator valve 282 into the chamber 250. Again, a water nozzle 282 carrying the moisture for humidification through a pipe 284 and regulated with a valve 286. The upper second wall portion 290 is now placed at the front of the inner combustion chamber as opposed to the chamber 250 being placed on the rear wall portion. In this alternate embodiment there is more heat brought to the forward portion of the fireplace because of this arrangement. Also, a coil 294 can be placed atop the plate 290 and the incoming line 296 carrying cold water into the coils and line 298 carrying it out for distribution.

A throat plate 300, in this case, can be mounted beneath the wall 290 and with its handle 302 can move the plate between guides 304 and having a stop 306 to limit the amount of movement for closing the throat portion 310.

Figure 7:
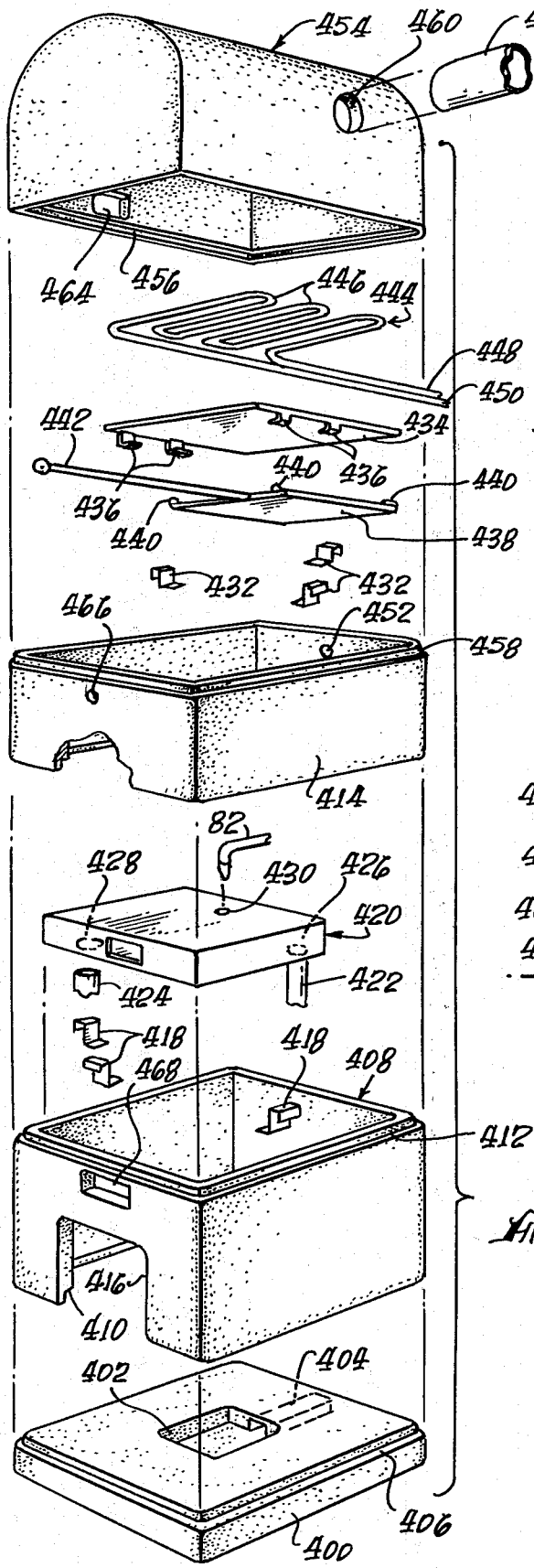
FIG. 7 is an exploded perspective view of the components which form the combustion chamber assembly of an alternate embodiment of my invention.
Figure 8:
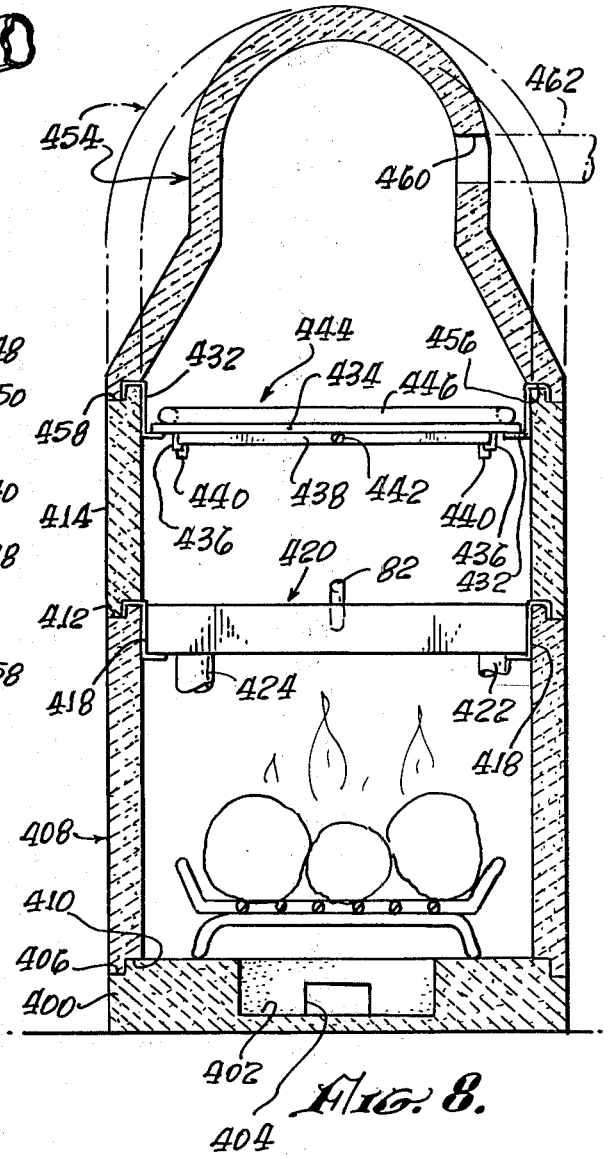
FIG. 8 is a sectional view similar to FIG. 3 illustrating this alternate embodiment.

In the perspective view of FIG. 7, I have provided a number of prefabricated components in order to be assembled in the manner to be described for constructing the camber of my invention.

A base 400, which can be precast out of a fire resistant and retardant material, is provided with an ash receiving recess 402 interconnected to a clean-out and air transporting tunnel 404 and having a step shelf 406 for receiving of a lower liner casting 408. This liner casting has a complimentary recessed portion 410 which fits onto the shelf 406. The upper edge of this lower casting also is provided with a shelf 412 for receiving a second liner casting 414. An opening is formed at 416 of a size to be fitted to a conventional fireplace door. A plurality of metal clip-like members 418 are then placed onto the upper edge of the lower casting 408 to provide a support means for the hollow metal lower chamber 420 which has been described in detail previously as chamber 50.

A water injection nozzle opening 430 is placed for the addition of said nozzle at a later time. Clips 432 similar to the clips 418 previously mentioned, are then placed at the opposite end of the combustion apparatus to that of the member 420.

Onto these clips 432 is supported a diversion and heat absorbing plate 434 having a number of guide members 436 affixed thereto. A damper plate 438 with stops 440 can be placed to slide between the guides 436. A handle 442 is then provided for operation by a person maintaining the combustion apparatus. A water coil assembly 444 having coil portions 446 is then placed atop the diversion plate 434. An inlet 448, an outlet 450 are then passed through an opening 452 which is formed into the liner unit 414.

A dome assembly 454 then is placed upon the member 414 so that its shelf 456 rests upon the shelf 458. An opening 460 for placement of a chimney pipe 462 completes the assembly of the combustion apparatus. Opening 464 is put into the dome 454 for access to cleaning the accumulated soot. Additionally, opening 466 for the rod 442 and the emergency opening 468 in case of blower failure is provided in the casting 408. The chamber 420 is formed in alignment with opening 468.

It can be seen that assembly of the various liner structures and the wall portions 420 and 434 can be done in a systematic manner. A sealing material can be placed between these sections at the shelf portions in order to secure the parts together.

Figure 3:
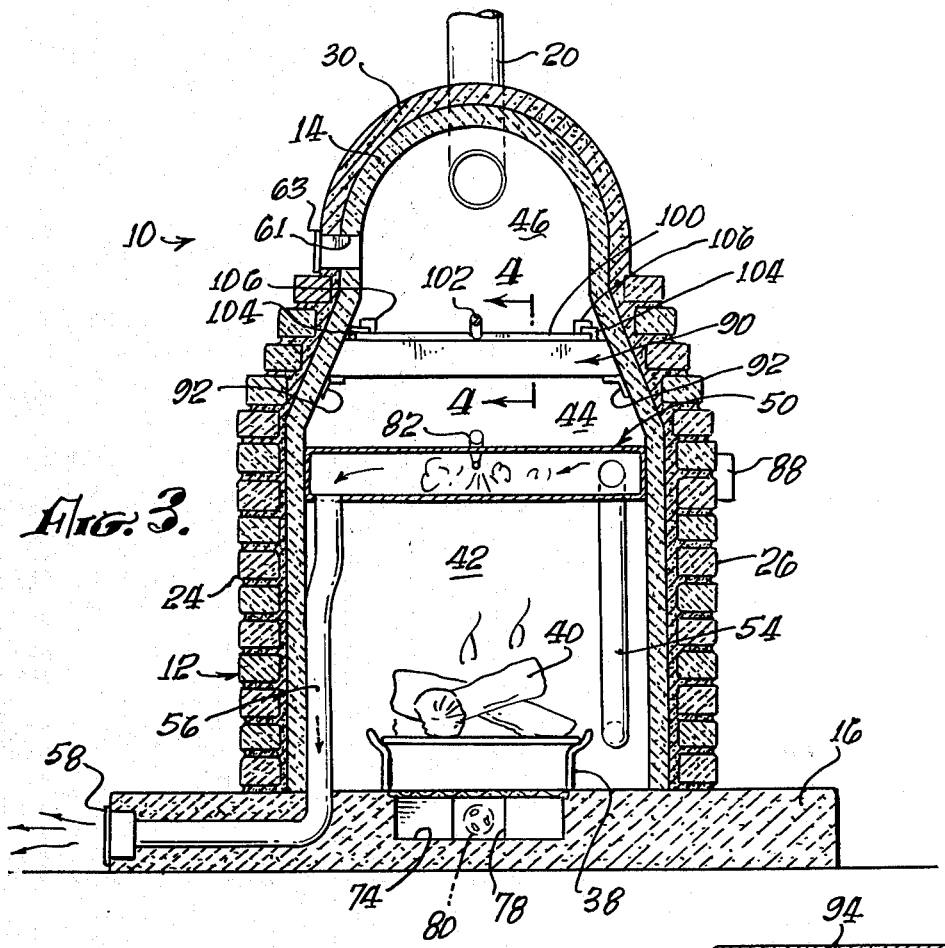
FIG. 3 is a section taken on line 3—3 of FIG. 2.
Figure 4:
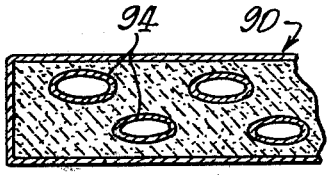
FIG. 4 is an enlarged section taken on line 4—4 of FIG. 3.
Figure 5:
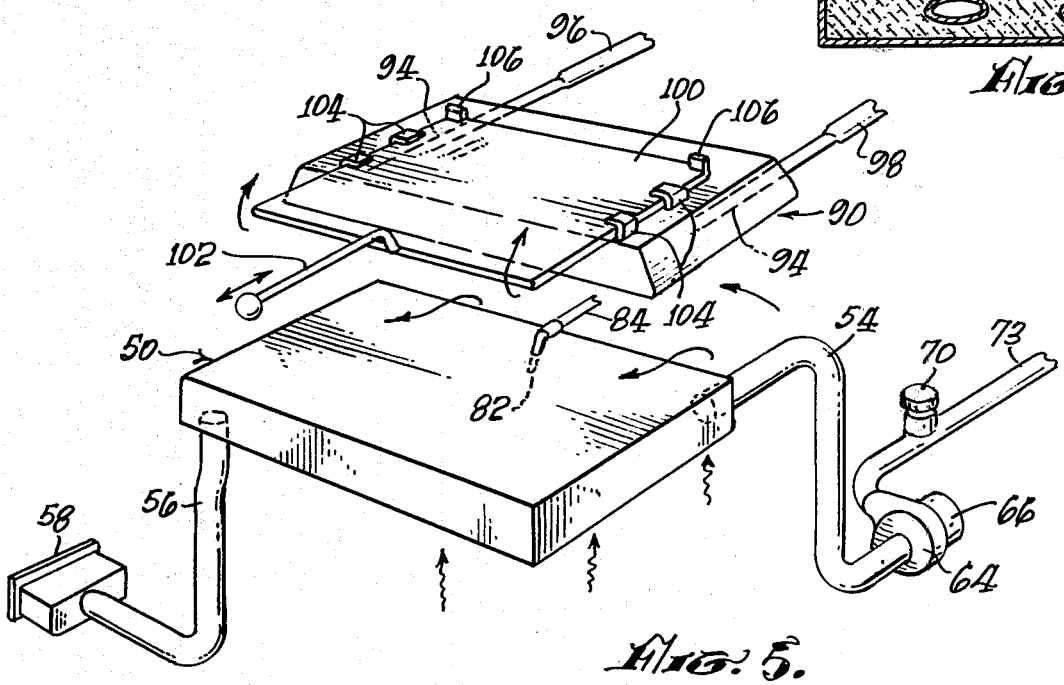
FIG. 5 is a schematic perspective illustrating the two chambers utilized in my invention.

A dome configuration similar to that of FIG. 3 can be easily structured having tapered walls in the casting 414 without much difficulty. A brick face can then be administered to the outside of the liner assembly for the purposes of design.

While the embodiments of this invention shown and described are fully capable of achieving the objects and advantages desired, it is to be understood that such embodiments are for the sole purpose of illustration and not for purposes of limitation.

I claim:

1. The method of assembling a combustion apparatus of the type containing a fuel burning chamber, a circulated air chamber with a humidifier incorporated therewith, and a heat sink mechanism for heating adjacent fluid conduit transporting apparatus which includes: (1) placing a fire and heat resistant base means upon a supporting surface; (2) providing a first fire and heat resistant combustion chamber liner means upon said base; (3) placing a first support means upon said combustion chamber liner means; (4) supporting a circulated air chamber means having a humidifier means incorporated therewith onto said first support means; (5) Stacking, in alignment, a second fire and heat resistant chamber liner means atop said first combustion chamber liner means; (6) placing a second support means upon said said second chamber liner means; (7) Supporting a combination heat sink means and adjustable damper means upon said second support means; (8) Installing a fluid transporting conduit means adjacent said heat sink means; and (9) stacking, in alignment, a fire and heat resistant vented closure means atop said second chamber liner means.

2. A combustion apparatus of the type containing a fuel burning chamber, a circulated air chamber with a humidifier incorporated therewith, and a heat sink mechanism for heating adjacent fluid conduit transporting apparatus which includes: a fire and heat resistant base means; a first fire and heat resistant combustion chamber liner means placed upon said base means; a first support means placed upon said first combustion chamber liner means; a circulated air chamber means having a humidifier means incorporated therewith; a second fire and heat resistant chamber liner means placed atop said first combustion chamber liner means; a second support means placed upon said second chamber liner means; a combination heat sink means and adjustable damper means placed upon said second chamber liner means; a fluid transporting conduit means located adjacent said heat sink means; and a vented fire and heat resistant means stacked in alignment upon said second chamber liner means.

3. The apparatus as set forth in claim 2 in which said first fire and heat resistant combustion chamber liner means is provided with controlled openings for fuel insertion and for venting of air to aid in combustion.

4. The apparatus as set forth in claim 3 wherein said humidifier means is controlled by a humidity sensing means.

5. The apparatus as set forth in claim 4 wherein said adjustable damper means is a plate means slidably retained adjacent said heat sink means, and said plate is controlled from the exterior of said second chamber liner means.

6. The apparatus as set forth in claim 5 wherein said fluid transporting conduit means is imbedded within said heat sink means.

* * * * *